United States Patent [19]

Watts

[11] Patent Number: 4,999,956

[45] Date of Patent: Mar. 19, 1991

[54] RICOCHET METAL STRIP CLEANER

[76] Inventor: W. David Watts, 4965 Highway 19 North, Alpharetta, Ga. 30201

[21] Appl. No.: 400,456

[22] Filed: Aug. 30, 1989

Related U.S. Application Data

[63] Continuation-in-part of Ser. No. 42,464, Apr. 28, 1987, now U.S. Pat. No. 4,872,294, which is a continuation-in-part of Ser. No. 824,460, Jan. 31, 1986, abandoned.

[51] Int. Cl.[5] ..... B24C 9/00

[52] U.S. Cl. ..... 51/420; 51/425; 51/426

[58] Field of Search ..... 51/425, 424, 426, 417, 51/420, 418

[56] References Cited

U.S. PATENT DOCUMENTS

| | | | |
|---|---|---|---|
| 2,037,047 | 4/1936 | Rosenberger | 51/424 |
| 2,204,588 | 6/1940 | Guite | 51/418 |
| 3,731,432 | 5/1973 | Carpenter, Jr. | 51/424 |

FOREIGN PATENT DOCUMENTS

| | | | |
|---|---|---|---|
| 1652005 | 10/1971 | Fed. Rep. of Germany | 51/424 |
| 2650188 | 5/1977 | Fed. Rep. of Germany | 51/418 |
| 2645559 | 6/1977 | Fed. Rep. of Germany | 51/424 |

*Primary Examiner*—Robert A. Rose
*Attorney, Agent, or Firm*—William Nitkin

[57] ABSTRACT

A shot blast device having at least one upper and at least one lower shot blast wheel disposed at angles to the direction of movement of a workpiece within a shot blast chamber, the upper shot blast wheel propelling shot downward onto the top of the workpiece and the lower shot blast wheel propelling shot upwards onto the bottom of the workpiece, the chamber having an upper deflector wall adapted to be struck by shot from the upper shot blast wheel reflected off the top of the workpiece, such shot being deflected to fall on a diverter plate disposed above the workpiece beneath the upper deflector wall, said diverter plate extending beyond the sides of the workpiece directing shot falling thereupon beyond the sides of the workpiece to a shot collection area at the bottom of the blast chamber.

4 Claims, 3 Drawing Sheets

RICOCHET METAL STRIP CLEANER

This application is a continuation-in-part of my previous application for Bar and Coil Descaler, Ser. No. 042,464 filed 04/24/87, now U.S. Pat. No. 4,872,294, which is a continuation-in-part of my previous application for a Bar Descaler, Ser. No. 824,460, filed 01/31/86, now abandoned.

BACKGROUND OF THE INVENTION

1. Field of the Invention

The apparatus of this invention resides in the area of blast machines and more particularly relates to a blast machine which propels shot at metal sheets or plates in order to clean them so that they are in suitable condition for further processing.

2. Description of the Prior Art

Blast machines have been used in the prior art to clean sheets, strips and plates of metal, some of which may initially be provided in the form of rolls or coils, for cleaning and descaling by delivering such workpieces on conveyors through long chambers which have shot blast wheels disposed above and below the sheet metal being cleaned. Such prior art machines have provided a plurality of shot blast wheels disposed in such long chamber through which the sheet is passed wherein each shot blast wheels cleans a specific portion of the upper or lower surface of the sheet. Some of the prior art cleaning machines have blast wheels disposed at a 45 degree angle to the metal sheets being cleaned.

When cleaning metal sheets, several problems arise in the prior art. One of these problems is warpage when cleaning thin-gauge metal sheets. Another problem is excessive shot buildup on the top of the metal sheet causing inadequate cleaning or shot blinding by preventing the top blast wheels from adequately cleaning the top of the metal sheet. Since there is already shot resting on the metal sheet, this buildup of shot blocks the impact of the shot stream coming from the blast wheels.

Other difficulties with the prior art stem from cleaning problems in the blast chambers themselves due to shot rebounding into the oncoming particle streams propelled by the shot blast wheels. Furthermore, excessive shot blast wheel wear can be caused by shot rebounding back into the wheel. In addition, high chamber wear can occur from shot which misses the metal sheet and hits the inside walls of the blast chamber at a direct 90 degree angle. These problems with prior art blast machines are compounded when deformation and warping of metal sheets is caused by blast machines that have hot spots in their blast patterns causing unequal blast intensity over the surface of the metal sheet resulting in deformation of the metal sheet being cleaned.

SUMMARY OF THE INVENTION

It is an object of this invention to provide a new design of a blast wheel cleaner with a new shot cleaning system to prevent shot from accumulating on top of the workpiece after blasting.

It is a further object of this invention to provide a blast wheel cleaner which eliminates warpage of thin gauge steel or other metal sheet workpieces passing through the cleaning chamber of this invention.

It is a still further object of this invention to dramatically reduce the wear of blast wheels while in use in the chamber of this invention as well as to reduce wear to the blast chamber itself.

It is yet a further object of this invention to prevent excessive shot buildup on the top surface of the metal sheet workpiece and to greatly improve the ability to clean the top surfaces of metal sheet, strip or plate workpieces. Reduction of shot buildup prevents the shot stream from being blinded by any such shot buildup on top of the workpiece.

To accomplish the goals of this invention a new chamber design has been developed which incorporates a ricochet system with diverter plates with an improved blast cleaning system that dramatically eliminates shot buildup from the top surface of the workpiece. The chamber is provided with at least two blast wheels. In the embodiment illustrated a series of four blast wheels, two upper blast wheels and two lower blast wheels are each mounted at an angle in the range of 20–40 degrees to the horizontal path of the workpiece creating an angle in the range of 50–70 degrees of abrasive impact onto the workpiece. The top and bottom blast wheels are positioned in such a way that the abrasive impact at the top and bottom of the metal sheet is directly opposite one another to produce balanced and equal opposing forces on the sheet's surface thereby preventing any warpage of the workpiece. The shot that impacts the top of the sheet, strip or plate workpiece rebounds off the top of the sheet at an angle equal to the angle of impact and the shot then strikes an upper deflector wall in the chamber and then falls, directed by a shot diverter plate, beyond both sides of the workpiece where the shot falls to the bottom of the chamber and is collected in a reclaiming area. This ricochet feature substantially reduces the buildup of shot on top of the workpiece. The shot which impacts the bottom surface of the workpiece rebounds into the chamber away from the oncoming shot at the angle at which it strikes the workpiece, and the spent shot then falls into the bottom reclaiming area where an auger directs it to an elevator for processing and recirculation within the system. Any abrasive shot from the system propelled by the top or bottom shot blast wheels that misses the sheet, impacts with each other beyond the sides of the workpiece with equal force thereby dissipating their respective energies and dramatically reducing chamber wear. After the sheet has passed beyond the shot blast patterns of the upper and lower shot blast wheels and such sheet passes beneath the shot diverter, any shot remaining on top of the sheet is removed by a cleaner such as a brush or blower which is disposed at the rear of the device.

DESCRIPTION OF THE PREFERRED EMBODIMENT(S)

Figure 1:
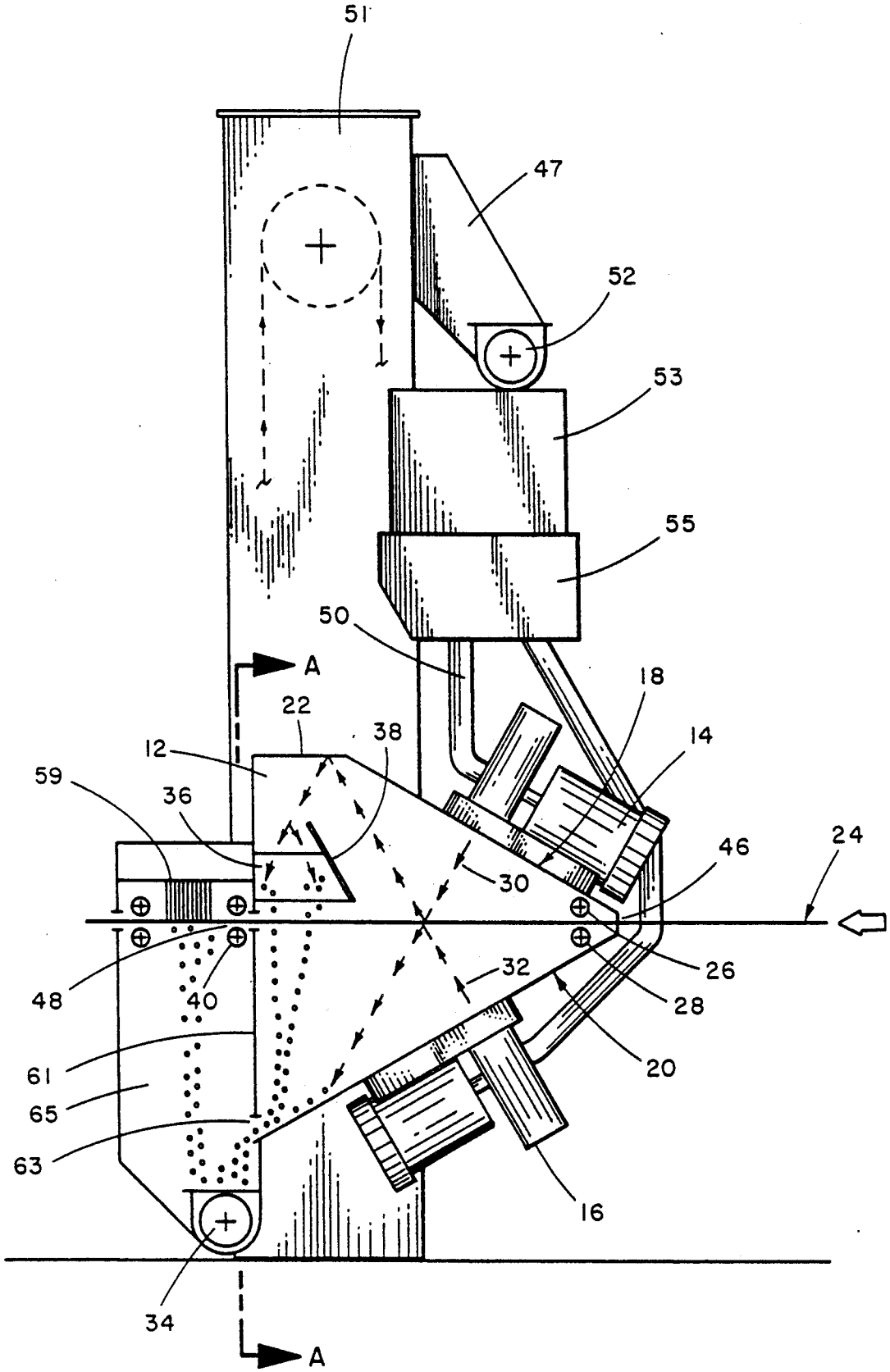
FIG. 1 illustrates a side elevational cutaway view of the cleaning chamber of this invention.

FIG. 1 illustrates a side elevational cutaway view of the device of this invention showing cleaning chamber 12 which is of a unique configuration and can be approximately 4–10 feet in length. Seen in this view is first upper blast wheel 14 disposed on upper chamber wall 18 at a 20–40 degree angle to the horizontal direction of workpiece 24. First lower blast wheel 16 is similarly disposed on lower chamber wall 20 at a similar 20–40 degree angle to the horizontal direction of workpiece 24. Workpiece 24 passes into blast chamber 12 through entry opening 46 between first upper conveyor roller 26 and first lower conveyor roller 28. Some machines do not use dual rollers and may use only a lower roller or a skid plate on which the sheet passes. The entry door can be approximately 1–15 feet wide to allow wide sheets to be passed through the ricochet cleaner of this invention.

Figure 2:
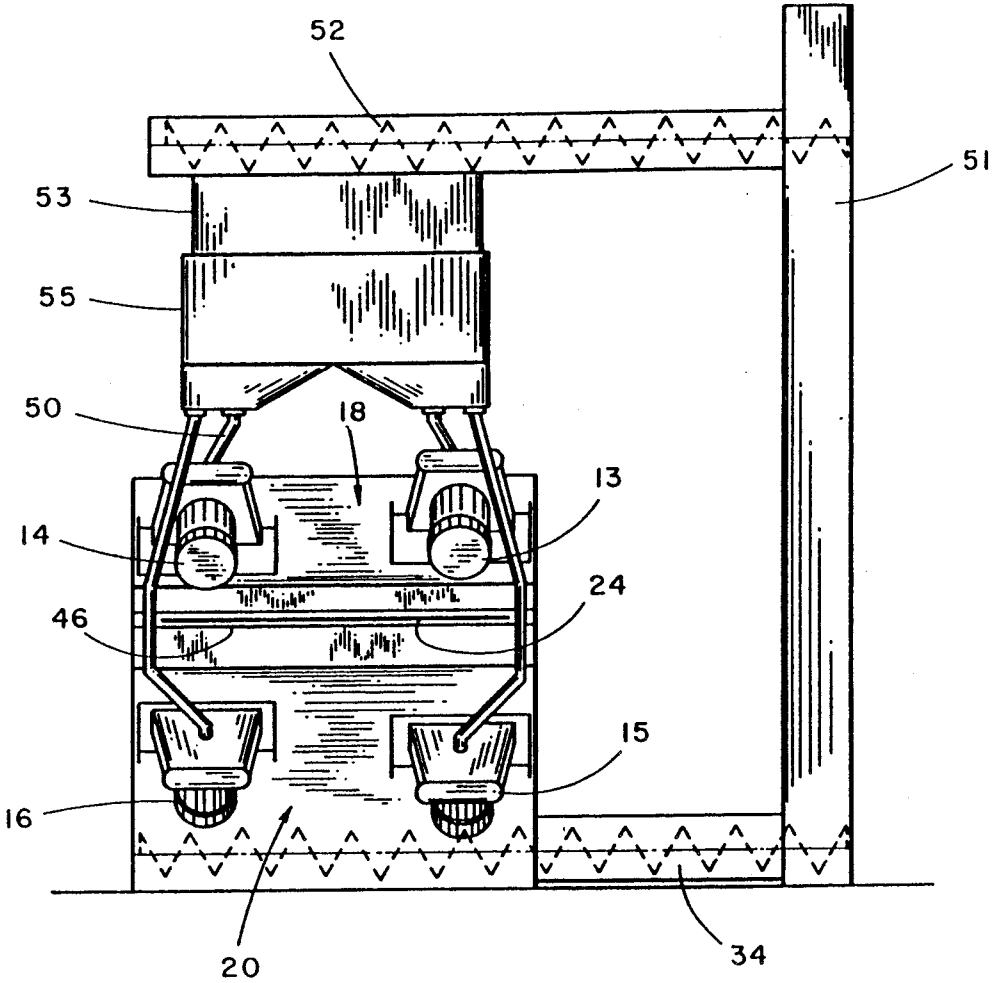
FIG. 2 illustrates a front elevational view showing the entry door where the workpiece enters the chamber of this invention.

The device of this invention in one embodiment can incorporate a second upper blast wheel and second lower blast wheel as seen in FIG. 2 where the second upper blast wheel 13 is seen mounted beside first upper blast wheel 14 on upper chamber wall 18, and second lower blast wheel 15 is seen mounted beside first lower blast wheel 16 on lower chamber wall 20. Seen between the chamber walls in this view is entry door 46 through which workpiece 24 enters. The blast patterns of these four blast wheels cover the upper and lower surfaces of the workpiece. The lower blast path 32 as seen in FIG. 1 emanates from first and second lower blast wheels 16 and 15, respectively, and extends upwards striking the bottom of workpiece 24 and reflects off at the same angle at which it strikes. The spent shot then falls downward to the bottom of blast chamber 12 where it falls through apertures in wall 61 to the bottom of chamber 65 and is collected and moved by lower auger 34 as will be described further below. Upper blast path 30 from first and second upper blast wheels 14 and 13, respectively, extends at a downward angle and strikes the upper surface of workpiece 24 to balance the force of the pressure from the blast pattern of the lower blast wheels and bounces off the upper surface of the workpiece at the same angle at which it strikes it which directs the reflected shot to a portion of the chamber being upper deflector wall 22 which extends horizontally. Deflector wall 22 then deflects the shot path over to shot diverter plate 36. Shot diverter plate 36 includes catch member 38 extending up the front thereof at an angle in line with the first reflected path of upper blast path 30. Catch member 38 prevents shot from falling off the front of diverter plate 36. The rear of the diverter plate is mounted on wall 61 of blast chamber 12 so that no shot can fall off the rear of the diverter plate. The shot striking upper deflector wall 22 falls downward at a reflected angle ricocheting onto shot diverter plate 36.

Figure 3:
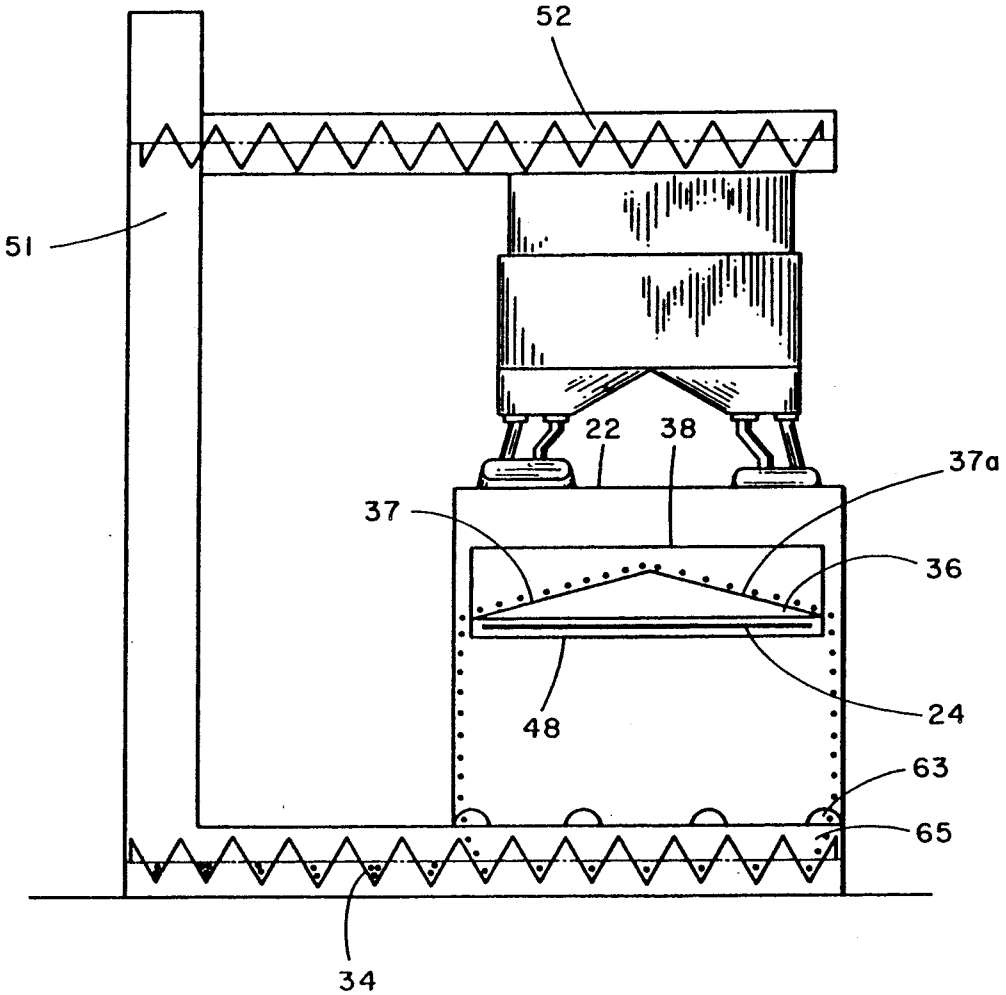
FIG. 3 illustrates a rear elevational cutaway view through A—A of FIG. 1.

In FIG. 3 one can see that shot diverter plate 36 forms angles with first plate side 37 and second plate side 37*a* extending downward at the same angle to both sides of workpiece 24. Shot falling on shot diverter plate 36 slides off by gravity on both sides beyond the side edges of workpiece 24, thus preventing most of the shot that strikes the top of the workpiece from collecting thereon. The shot falling off the ends of shot diverter plate 36 falls beyond the sides of workpiece 24 down into the base of the blast chamber and slides through aperture 63 to the shot removal chamber 65 as seen in FIG. 1 where it is also picked up and driven by lower auger 34 as will be described further below. The workpiece passes over second conveyor roller 40 seen in FIG. 1 into shot removal chamber 65 where any remaining shot is removed from the top surface of the workpiece by blower or brush 59 as seen in FIG. 1 and falls down to lower auger 34 where it is moved by rotation of the auger to elevator 51 which carries it upward to head chute 47 which directs the shot to upper auger 52 where it is moved back above blast chamber 12. The shot then falls through separator 53 into abrasive storage bin 55 where it then passes through feed pipes to the blast wheels. First feed pipe 50 returns shot to first upper blast wheel 14, and second feed pipe 49 returns shot to first lower blast wheel 16. In the same way other feed pipes carry shot to the second set of blast wheels as seen in FIG. 2. After the shot has been removed from the top surface of the workpiece, the workpiece is then ready for further processing.

Thus it is seen that the new ricochet blast pattern of the blast wheels in the cleaning chamber of this invention having shot blast patterns which first strike the workpiece and then reflect off at angles away from the blast wheels protects the blast wheels from being struck and eroded by the shot itself. Any shot which happens to miss the workpiece strikes the opposing shot stream near the middle of blast chamber 12, and the force of the propelled shot is neutralized because it is striking other propelled shot coming at the same force. Shot which strikes the bottom of the workpiece reflects downward therefrom and falls to the bottom of the blast chamber to be recycled. The shot coming from the top of the blast chamber, instead of blasting against the top surface of the workpiece and ultimately remaining there, ricochets off and then strikes the upper deflector wall and is then reflected to the shot diverter plate with its catch member which then directs the flow of the shot off the ends of the diverter plate beyond the sides of workpiece so that the shot that is caught in the ricochet system no longer remains on the upper surface of the workpiece. A series of ricochet blast chambers can be disposed one after another in the same line for additional cleaning of the workpiece.

Although the present invention has been described with reference to particular embodiments, it will be apparent to those skilled in the art that variations and modifications can be substituted therefor without departing from the principles and spirit of the invention.

I claim:

1. An improved shot blast cleaning device for cleaning a workpiece, comprising:

a cleaning chamber;

means for moving said workpiece through said cleaning chamber;

at least one pair of shot blast wheels disposed at an angle in the range of 20–40 degrees to the direction of movement of said workpiece, said first shot blast wheel located above said workpiece and said second shot blast wheel located below said workpiece, said first and second shot blast wheels directing shot at said workpiece;

shot collection means located at the bottom of said cleaning chamber;

an upper deflector wall disposed horizontally within said cleaning chamber above said workpiece, said deflector wall adapted to be struck by the blast pattern of said first shot blast wheel reflecting off said workpiece at an angle equivalent to the angle at which the blast pattern of said first shot blast wheel strikes said workpiece; and a shot diverter plate having a front and sides centrally disposed above said workpiece beneath a portion of said upper deflector wall beyond the area where said upper deflector wall is struck by said blast pattern, said shot diverter plate having its sides extending from its center downward beyond the sides of said workpiece, said shot diverter plate adapted to catch shot after rebounding at an angle off said upper deflector wall, said rebounding angle being equivalent to the angle at which said shot struck said upper deflector wall after being reflected off said workpiece and to direct said shot to fall by gravity beyond the ends of said workpiece to prevent any shot on said shot diverter plate from falling on top of said workpiece, said diverted shot and rebounding shot falling into said shot collection means.

2. The device of claim 1 further including:

a planar catch member disposed on the front of said shot diverter plate, said catch member positioned at an angle in line with the shot reflected off said workpiece to minimize it being struck by said shot, said catch member to prevent shot from falling off the front of said shot diverter plate onto said workpiece.

3. The device of claim 2 further including:

an entry way defined in said cleaning chamber to receive said workpiece;

an upper chamber wall disposed above and adjacent to said entry way, said upper chamber wall being positioned at an angle to the movement of said workpiece, said angle being in the range of 20–40 degrees to the direction of movement of said workpiece and on which upper chamber wall said first shot blast wheel is mounted; and a lower chamber wall disposed below and adjacent to said entry way, said lower chamber wall being positioned at an angle to the movement of said workpiece, said angle being in the range of 20–40 degrees to the direction of movement of said workpiece and on which lower chamber wall said second shot blast wheel is mounted.

4. The device of claim 3 further including:

a third shot blast wheel mounted adjacent and disposed at the same angle to said first shot blast wheel on said upper chamber wall; and a fourth shot blast wheel mounted adjacent and disposed at the same angle to said second shot blast wheel on said lower chamber wall.

* * * * *